US007464908B2

(12) United States Patent
Files

(10) Patent No.: US 7,464,908 B2
(45) Date of Patent: Dec. 16, 2008

(54) ROTATABLY ADJUSTABLE QUIVER SUPPORT

(76) Inventor: John G. Files, 6331 Rodeo Dr., Bastrop, LA (US) 71220

( * ) Notice: Subject to any disclaimer, the term of this patent is extended or adjusted under 35 U.S.C. 154(b) by 297 days.

(21) Appl. No.: 11/236,028

(22) Filed: Sep. 27, 2005

(65) Prior Publication Data

US 2006/0065261 A1 Mar. 30, 2006

Related U.S. Application Data

(60) Provisional application No. 60/614,433, filed on Sep. 30, 2004.

(51) Int. Cl.
*F16B 1/00* (2006.01)
*F41B 5/06* (2006.01)

(52) U.S. Cl. ..... 248/229.16; 248/597; 224/196; 224/197; 124/86

(58) Field of Classification Search ..... 248/229.16, 248/292.12, 292.13, 597, 596, 598; 124/86, 124/25.7, 25.5, 24 A, 87, 44.5; 224/916, 224/197, 272, 271, 930, 199, 597, 198, 912, 224/196; 33/265; 403/322.4, 349; 24/665, 24/3.7, 3.11

See application file for complete search history.

(56) References Cited

U.S. PATENT DOCUMENTS

| | | | | |
|---|---|---|---|---|
| 2,987,230 | A | 6/1961 | Taylor | 224/5 |
| 3,017,874 | A | 1/1962 | Gubash | 124/23 |
| 3,434,638 | A | 3/1969 | Beynon | 224/1 |
| 3,595,214 | A | 7/1971 | O'Malley | 124/24 |
| 3,601,113 | A | 8/1971 | Wilkie | 124/48 |
| 4,247,027 | A | 1/1981 | Tardiff | 224/197 |
| 4,363,312 | A | 12/1982 | Spitzke | 124/45 |
| 4,823,764 | A | 4/1989 | Knaack | 124/88 |
| 5,076,522 | A | 12/1991 | Stinson | 248/216.1 |
| 5,957,421 | A | 9/1999 | Barbour | 248/220.21 |
| 6,105,566 | A | 8/2000 | Tiedemann | 124/86 |
| 6,328,189 | B1 | 12/2001 | Norden | 224/197 |
| 6,666,204 | B1 | 12/2003 | Hedrick | 124/86 |
| 6,672,299 | B2 | 1/2004 | Proctor | 124/86 |
| 6,685,067 | B2 * | 2/2004 | French | 224/198 |
| 6,817,499 | B2 * | 11/2004 | Martinez | 224/197 |
| 6,889,878 | B2 * | 5/2005 | Parsons | 224/200 |
| 6,955,279 | B1 * | 10/2005 | Mudd et al. | 224/197 |
| 7,077,119 | B1 * | 7/2006 | Dube et al. | 124/86 |

* cited by examiner

*Primary Examiner*—Anita M King
(74) *Attorney, Agent, or Firm*—John M. Harrison

(57) ABSTRACT

A rotatably adjustable quiver support which is characterized in a preferred embodiment by a quiver mount bracket for removable attachment to the conventional quiver mount plate on a quiver containing a supply of arrows, a clip base directly rotatably engaging the quiver mount bracket or alternatively, rotatably engaging a spacer connected to the quiver mount bracket and a rotatable element extending from the quiver mount bracket to the clip base or from the spacer attaching the quiver mount bracket to the clip base, to facilitate incremental rotation of the quiver and quiver mount bracket with respect to a point of mount, typically facilitated by a clip secured to the clip base. The clip base can be attached to a bow, a bow sight mount, a belt, a deer stand or blind or to a backpack strap or other strap, with or without a clip, to facilitate selective incremental rotation of the quiver and quiver mount bracket with respect to the clip and positioning the quiver-mounted arrows in various desirable hunting access configurations. A spike mount and retractable spike can also be typically attached to the spacer and mount bracket elements to facilitate removal from the spacer and mounting the quiver and quiver mount bracket on a tree or limb using the spike.

7 Claims, 7 Drawing Sheets

ROTATABLY ADJUSTABLE QUIVER SUPPORT

CROSS-REFERENCE TO RELATED APPLICATIONS

This application claims the benefit of and incorporates by reference prior filed copending U.S. Provisional Application Ser. No. 60/614,433, Filed Sep. 30, 2004.

SUMMARY OF THE INVENTION

This invention relates to a rotatably mounted quiver containing a supply of arrows and more particularly, to a rotatably adjustable quiver support designed to mount on the conventional quiver mount plate or element of a conventional quiver and having a clip designed for attachment to a bow, a bow sight mount or the belt of a user or to a backpack strap or other strap, a deer stand or a blind, as well as to a tree or tree limb, in non-exclusive particular. In a preferred embodiment the rotatably adjustable quiver support is characterized by a conventional quiver mount bracket designed to typically removably receive and attach to the quiver mount plate or element on the quiver, a spacer connected to or shaped in the quiver mount bracket and a cylindrical spacer pivot element projecting from the spacer and extending through a corresponding pivot receptacle provided in a clip base typically featuring a clip. The spacer pivot is typically fitted with a spring and has teeth that selectively engage corresponding grooves in the pivot receptacle responsive to adjustment of the spacer with respect to the clip base using spring tension. Accordingly, the quiver, quiver mount bracket and spacer are incrementally rotatable in concert with the spacer pivot with respect to the clip base and clip when the spacer is positioned against the clip base and the teeth are disengaged from the grooves. This rotation allows incremental 360-degree positioning of the quiver and arrows with respect to the bow, bow sight, belt, backpack strap, deer stand or blind, tree or alternative support, to which the clip base is clipped or mounted when the teeth are again seated in the grooves as the spacer is spaced-apart from the clip base, typically by spring tension.

In another preferred embodiment the quiver support is attached to a spike mount that removably engages the spacer element and houses a retractable, hinged spike for threading into a tree or limb and attaching the quiver to the tree or limb. In this and other embodiments of the invention the cylindrical spacer pivot, typically having radially-oriented teeth, extends from the spacer through the pivot receptacle, typically provided with radial receptacle grooves in the clip base and a coil spring extends transversely through the spacer pivot, causing the spacer pivot teeth to normally engage the respective receptacle grooves in the clip base. A cap on the spacer pivot adjacent to the teeth prevents the spacer pivot from exiting the pivot receptacle toward the spacer while the quiver is pivoted with respect to the clip base and clip when the teeth are disengaged from the grooves against spring tension. Accordingly, disengagement of the spacer pivot teeth from the pivot receptacle grooves responsive to pressure applied to the quiver against spring tension facilitates rotation of the quiver and positions the quiver in a desired rotational orientation with respect to a clipped or mounted position on the bow, bow sight, belt, backpack strap or other strap, deer stand or blind, tree or like support. Release of pressure on the quiver facilitates optimum positioning of the quiver and retrieval of the arrows from the quiver.

In another embodiment of the invention the spacer can be eliminated from its position between the quiver mount bracket and the clip base and spacer pivot then shaped in or mounted directly on the conventional quiver mount bracket and extended into the pivot receptacle in the clip base in the manner described above. Furthermore, the clip can be removed from the clip base and the clip base bolted or otherwise secured to the mount object, as desired.

BRIEF DESCRIPTION OF THE DRAWINGS

The invention will be better understood by reference to the accompanying drawings, wherein.

DESCRIPTION OF THE PREFERRED EMBODIMENTS

Figure 3:
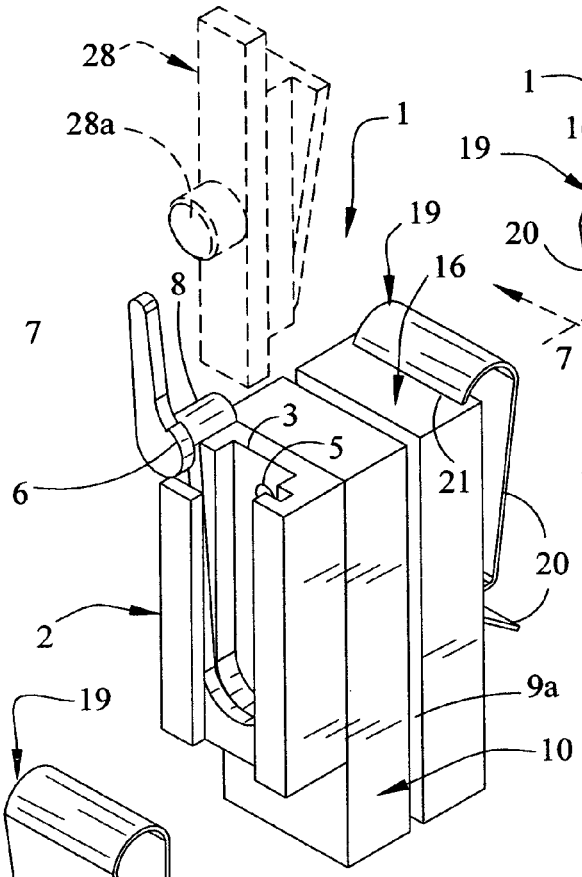
FIG. 3 is a front perspective view of the rotatably adjustable quiver support illustrated in FIGS. 1 and 2, more particularly illustrating removable engagement and securing of the conventional quiver mount plate (illustrated in phantom) in the quiver mount bracket slot of the quiver mount bracket element of the quiver support.
Figure 4:
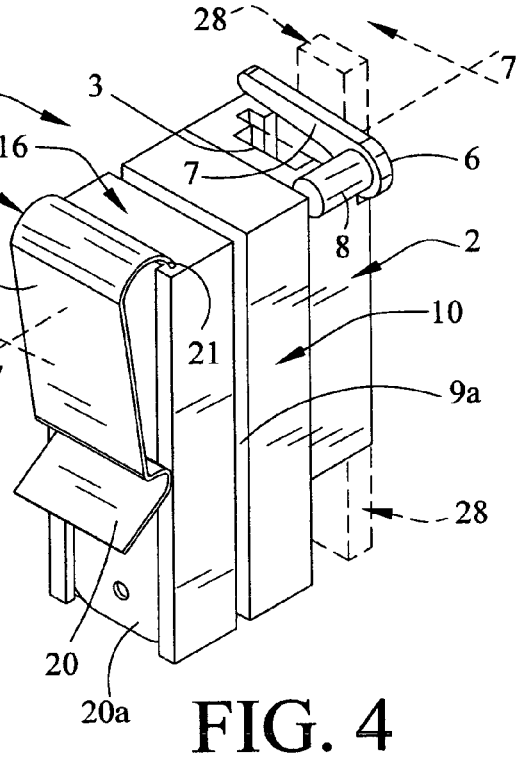
FIG. 4 is a rear perspective view of the rotatably adjustable quiver support illustrated in FIG. 3, more particularly illustrating removable attachment of the quiver mount bracket element of the quiver support to the quiver mount plate illustrated in phantom in FIG. 3.
Figure 5:
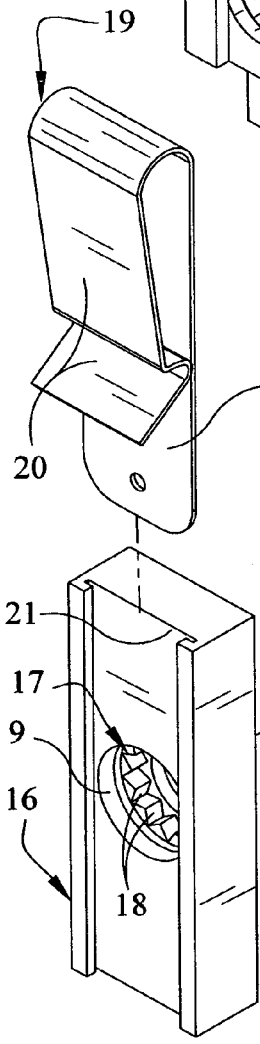
FIG. 5 is an exploded view of the rotatably adjustable quiver support illustrated in FIG. 3, with the cam lever element on the quiver mount bracket open to receive the quiver mount plate.
Figure 5:
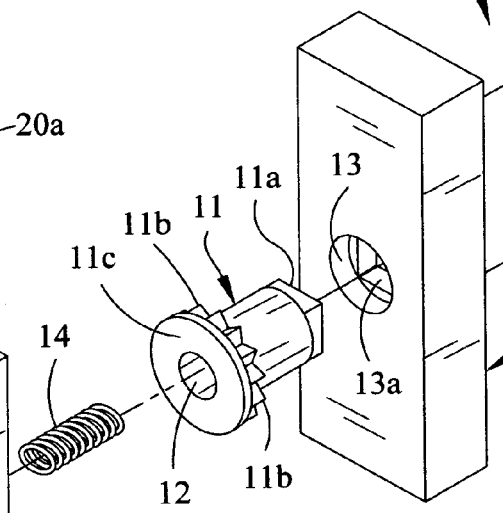
Figure 6:
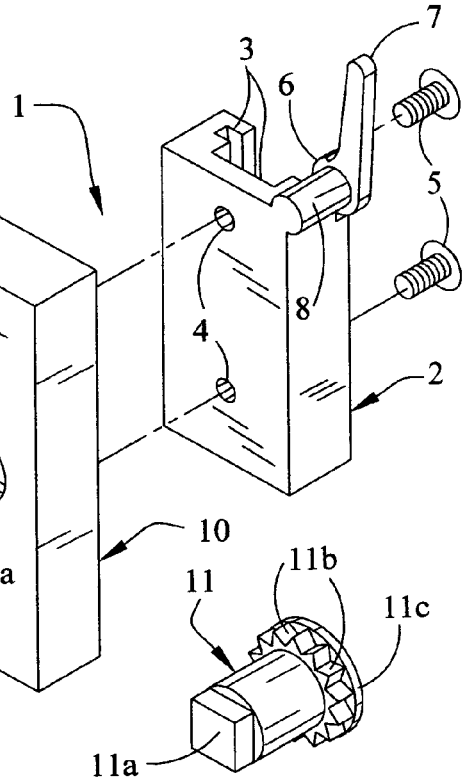
FIG. 6 is a perspective view of a spacer pivot element of the rotatably adjustable quiver support illustrated in FIG. 5.

Referring initially to FIGS. 1-6 of the drawings, in a first preferred embodiment the rotatably adjustable quiver support (herein after called "quiver support") of this invention is generally illustrated by reference numeral 1. The quiver support 1 is typically removably mounted on a bow 35, having a bow string 36, both illustrated in phantom in FIGS. 1 and 2. The quiver support 1 is characterized by a conventional quiver mount bracket 2 having a quiver mount bracket slot 3 in one side or face and fitted with a pair of spaced-apart mount bolt openings 4 extending transversely through the quiver mount bracket 2, as illustrated in FIG. 5. A pair of mount bolts 5 extend through the mount bolt openings 4 respectively, and thread into corresponding threaded seats (not illustrated) provided in a companion spacer 10, which lies adjacent to the quiver mount bracket 2, as further illustrated in FIGS. 3-5. A conventional cam 6 is pivotally attached to a cam mount 8 extending from one corner of the quiver mount bracket 2 adjacent to the quiver mount bracket slot 3 and a cam lever 7 extends from the cam 6 for purposes which will be hereinafter further described.

The spacer 10 has a selected thickness and is typically removably fitted to the quiver mount bracket 2 and secured in place by means of the mount bolts 5, as described above. A generally cylindrically-shaped spacer pivot 11 projects from the opposite side of the spacer 10 from the quiver mount bracket 2 location and includes a square block end 11 a at one end and a longitudinal spring seat 12 for receiving a coil spring 14, as further illustrated in FIGS. 5 and 6. Multiple, radially-oriented keeper teeth 11*b* are provided in the opposite end of the spacer pivot 11 from the block end 11*a* and a flat spacer pivot cap 11*c* covers one side of the keeper teeth 11*b*. The spacer pivot cap 11 and keeper teeth 11*b* of the spacer pivot 11 are designed to project into a pivot receptacle 17 located in a clip base 16 lying adjacent to the spacer 10, as further illustrated in FIG. 5. In a preferred embodiment the pivot receptacle 17 is fitted with multiple, radially-oriented receptacle sawtooth grooves 18, along with a radial disengaging space 9, for sequentially receiving the projecting and spring-loaded spacer pivot cap 11*c* and keeper teeth 11*b* end of the spacer pivot 11, as illustrated in FIGS. 4 and 5. The opposite block end 11*a* of the spacer pivot 11 is inserted in a spacer opening 13 provided in the spacer 10 (FIG. 5) and is seated in a corresponding block end seat 13*a* of like shape, typically in tight, but removable fashion. Accordingly, in a preferred embodiment of the invention the spacer 10 and attached quiver mount bracket 2 are rotatably secured to the clip base 16 by means of the spacer pivot pin 11, to facilitate in concert orientation of the quiver 27, the conventional quiver mount bracket 2 and the spacer 10 in a desired position with respect to the clip base 16, as hereinafter described.

As further illustrated in FIGS. 3-5 of the drawings, a clip 19 has a typically reverse-curved clip leg 20 and a straight mount leg 20*a*, the latter of which is secured in a clip groove 21 to the outer face of the clip base 16 opposite the inner face of the clip base 16 facing the spacer 10. The typically removable clip 19 facilitates attaching the quiver support 1 to a suitable support member, as hereinafter further described. The clip 19 also serves to engage the coil spring 14 in the spacer pivot 11 and prevents both elements from exiting the pivot receptacle 17 against the tension in the compressed coil spring 14.

Referring again to FIGS. 1-4 of the drawings, it will be appreciated that in a preferred embodiment of the invention the quiver support 1 can be mounted on a conventional quiver mount plate 28, typically having a plate fastener 28*a* and illustrated in phantom in FIGS. 2 and 3. This is accomplished by inserting the wedge-shaped portion of the quiver mount plate 28 in the quiver mount bracket slot 3 of the conventional quiver mount bracket 2 and rotating the cam lever 7 from the position illustrated in FIG. 3 to the position illustrated in FIG. 4 and lock the cam 6 against the quiver mount plate 28 and secure the quiver support 1 on the quiver 27 to which the quiver mount plate 28 is attached. The conventional quiver 27 is designed to secure a selected number of arrows 29, also illustrated in phantom in FIGS. 1 and 2, and resting in corresponding arrow seats (FIGS. 1 and 2), such that the quiver 27 is incrementally rotatable with the quiver mount bracket 2 and the spacer 10, all with respect to the clip 19 and clip base 16 elements of the quiver support 1, as hereinafter further described.

It will be further appreciated by those skilled in the art that alternative designs of the conventional quiver mount bracket 2 may be used in the quiver support 1. For example, the conventional quiver mount bracket 2 may have a conventional spring lever (not illustrated), extending downwardly from a spring lever grip and having a spring lever keeper that secures the bottom end of the spring lever to the base of the quiver mount bracket 2. In this design, since the quiver mount bracket 2 is fitted with a quiver mount bracket slot 3 for accommodating the wedge-shaped portion of the quiver mount plate 28 (FIG. 3), the spring lever grip can be forced rearwardly by thumb or finger pressure from the closed position to the open position, clearing access to the quiver mount bracket slot 3 against the tension in the spring lever, for accommodating the quiver mount plate 28. The spring lever is then returned to the closed position by releasing the thumb or finger pressure on the spring lever grip to secure the quiver mount plate 28 in mounted position on the quiver support 1. The clip 19 can then be attached to a suitable support member as hereinafter described.

Figure 7:
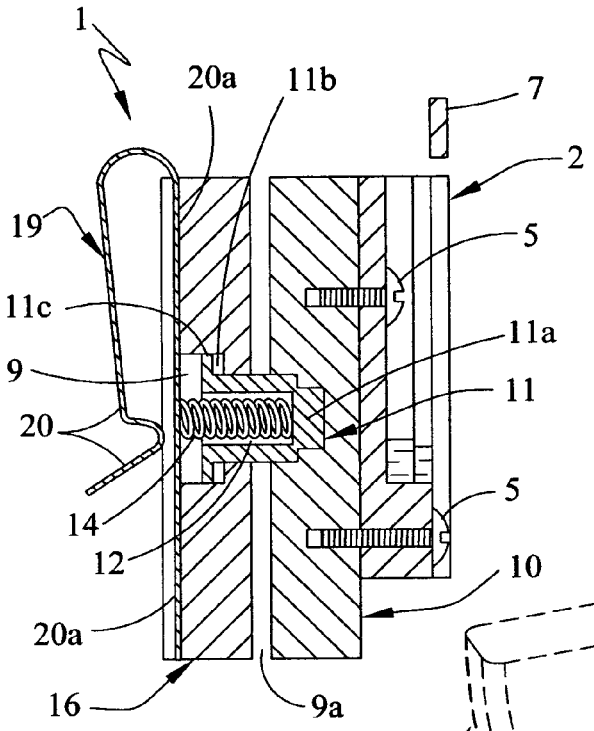
FIG. 7 is a longitudinal sectional view taken along line 7-7 of the rotatably adjustable quiver support illustrated in FIG. 4.

Referring now to FIGS. 1-8 of the drawings, a quiver 27 (FIGS. 1 and 2) and the quiver mount bracket 2, as well as the spacer 10 may be quickly and easily rotatably adjusted with respect to the fixed clip base 16 and clip 19 as follows: As illustrated in FIG. 7, the quiver mount bracket 2 and spacer 10 are immobilized with respect to the adjacent clip base 16 under circumstances where the tension in the coil spring 14, located in the spring seat 12 of the spacer pivot 11, causes the spacer 10 to be spaced apart from the clip base 16, thus creating a block space 9*a*. Under these circumstances the keeper teeth 11*b*, which are radially oriented on the spacer pivot 11, engage corresponding radial receptacle grooves 18 provided in the pivot receptacle 17 of the clip base 16 as illustrated in FIGS. 5 and 7 of the drawings. Accordingly, the spacer 10 and the quiver mount bracket 2, as well as the quiver 27 (FIGS. 1 and 2) cannot rotate with respect to the clip base 16.

Figure 8:
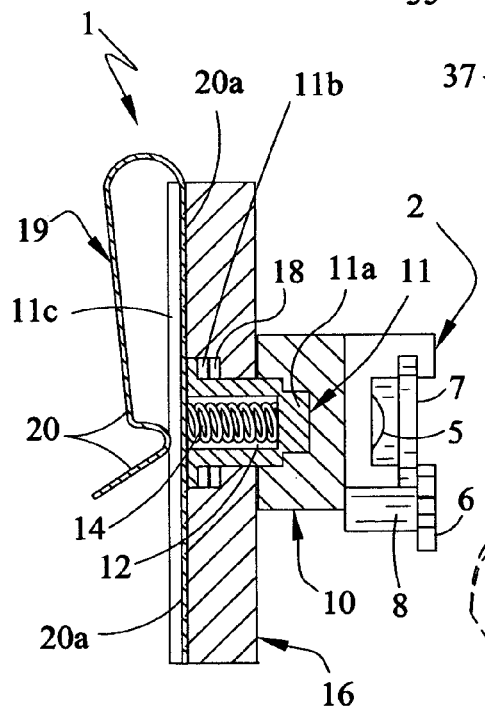
FIG. 8 is a sectional view of the rotatably adjustable quiver support illustrated in FIG. 7, more particularly illustrating pressure applied to the quiver and the quiver mount bracket to compress the coil spring and facilitate rotation of the quiver, the attached quiver mount bracket and the spacer element, as illustrated in FIG. 1.

When it is desired to rotate the spacer 10 and the quiver mount bracket 2, as well as the quiver 27 with respect to the clip base 16, the quiver 27, spacer 10 and quiver mount bracket 2 are forced inwardly in concert to close the block space 9*a*, as illustrated in FIG. 8 of the drawings. This action also compresses the coil spring 14, which is maintained in the spring seat 12 by means of the mount leg 20*a* of the clip 19. This compressive force thus disengages the keeper teeth 11*b* on the spacer pivot 11 from the corresponding fixed receptacle grooves 18, as the cylindrical spacer pivot cap 11*c* and the keeper teeth 11*b* recess linearly into the corresponding disengaging space 9 provided in the pivot receptacle 17, as further illustrated in FIGS. 5, 7 and 8 of the drawings. Accordingly, with application of this compressive force both the spacer 10 and the quiver mount bracket 2, as well as the quiver 27 (FIGS. 1 and 2) are allowed to pivot in a 360-degree range of motion with respect to the clip base 16 to position the quiver 27 in any desired rotatable configuration with respect to the object to which the quiver support 1 is affixed, as further illustrated in FIGS. 1 and 2. Release of the compressive force from the spacer 10 and the quiver mount bracket 2, as well as the quiver 27, effects a reverse linear movement of the spacer 10 from contact with the clip base 16 and re-engagement of the keeper teeth 11*b* with the receptacle grooves 18, to again create the block space 9*a* corresponding to the tension in the coil spring 14 and maintain the quiver 27 in the desired rotated position.

Figure 1:
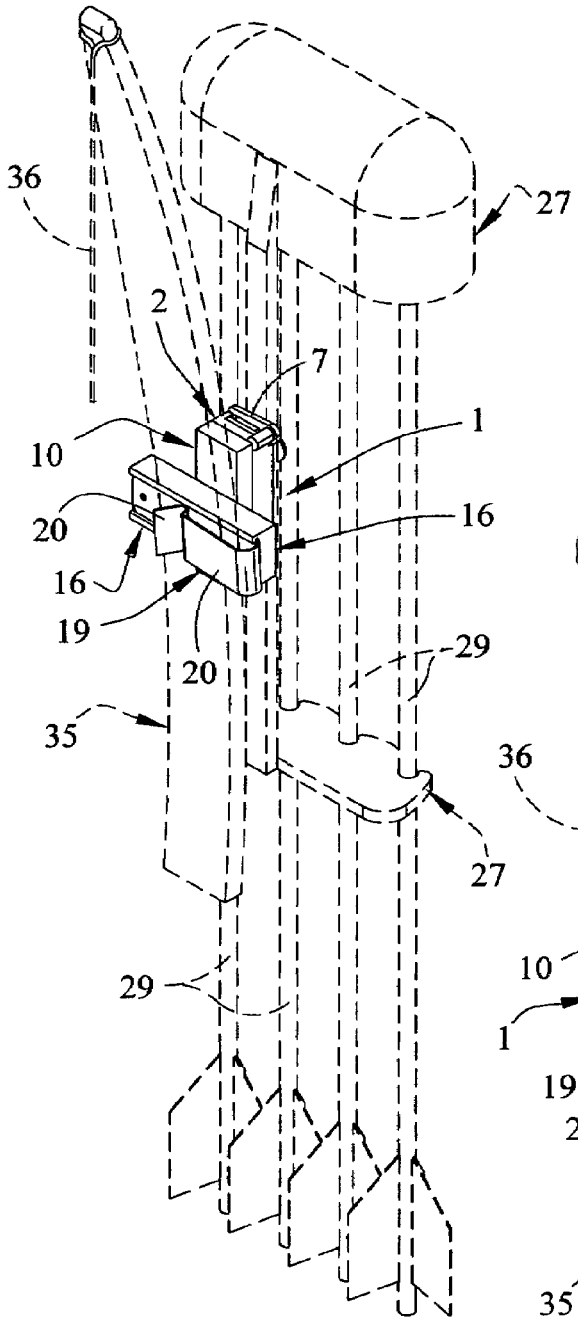
FIG. 1 is a perspective view of a preferred embodiment of the rotatably adjustable quiver support, having a conventional quiver mount bracket secured to the conventional quiver mount plate of a quiver (illustrated in phantom), a spacer element fixed to the quiver mount bracket and a clip base rotatably secured to the spacer and fitted with a clip for attachment to a bow (also illustrated in phantom) and rotatably securing the quiver to the bow.
Figure 2:
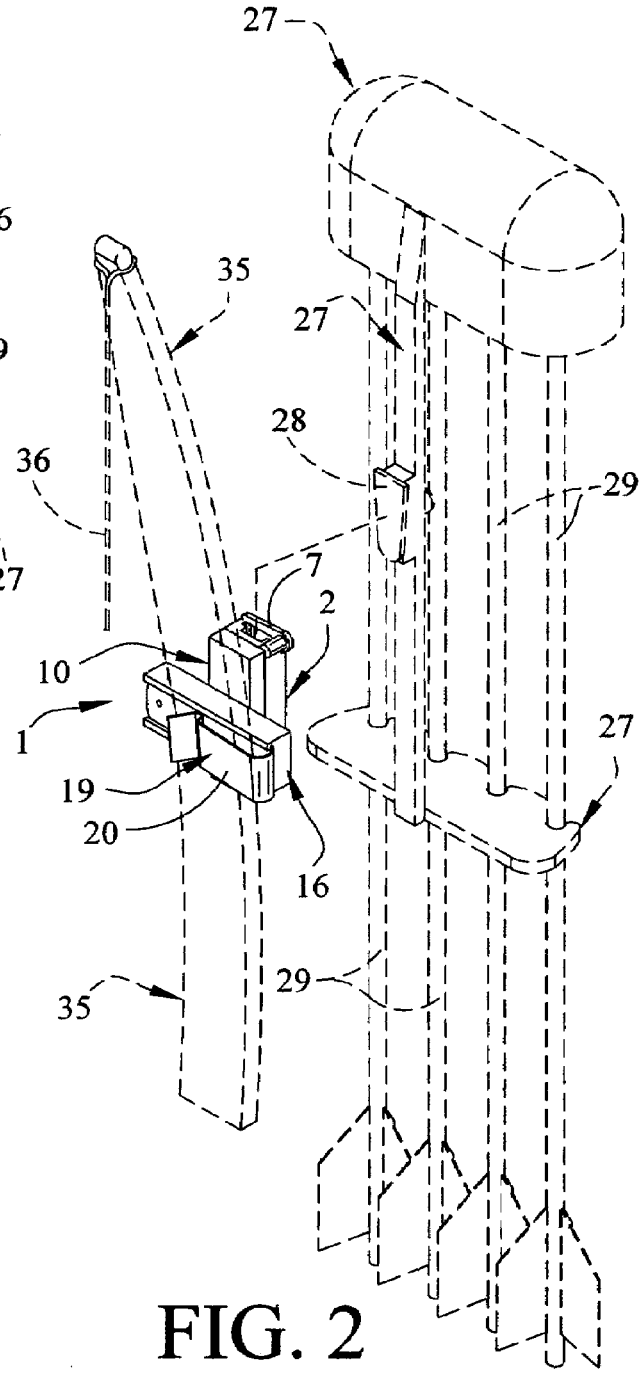
FIG. 2 is a perspective view of the rotatably adjustable quiver support illustrated in FIG. 1 with the quiver mount plate and quiver removed from attachment to the quiver mount bracket element of the quiver support.
Figure 9:
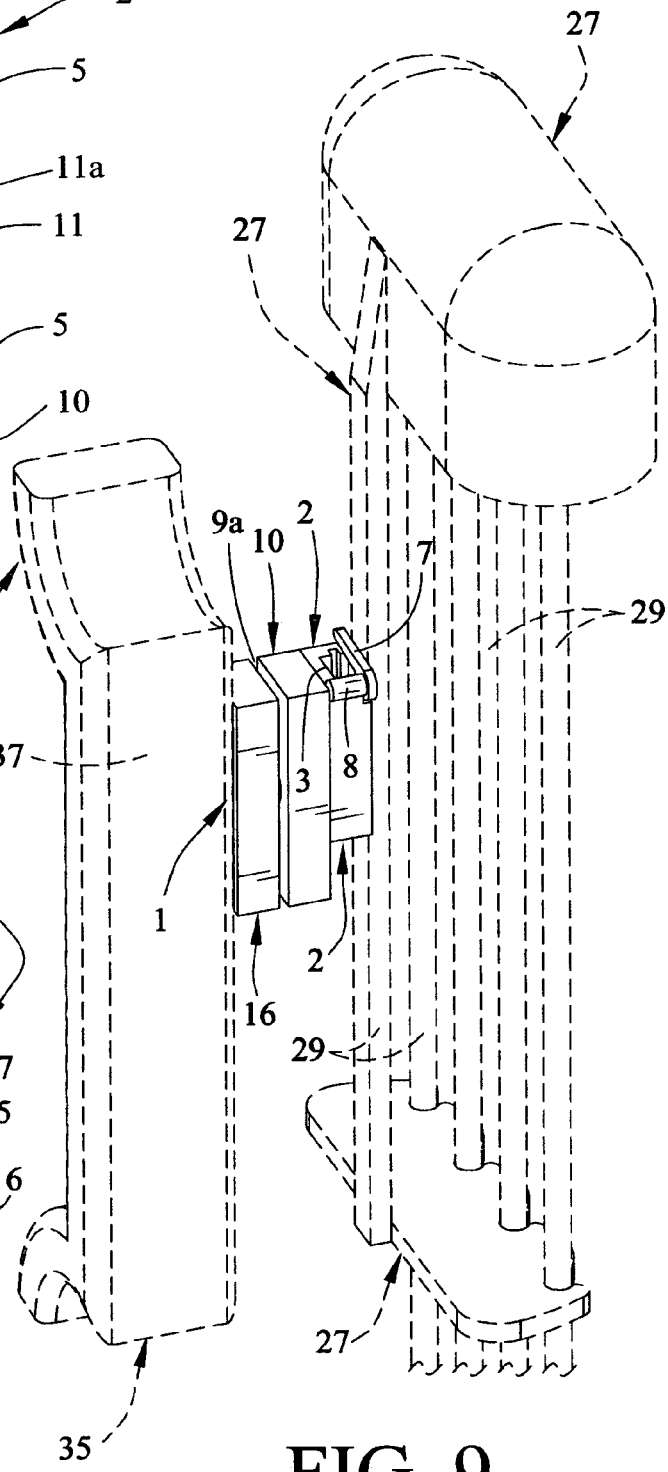
FIG. 9 is a perspective view of a preferred embodiment of the rotatably adjustable quiver support illustrated in FIGS. 1-5, without a clip and mounted on the handle or grip of a bow (illustrated in phantom)

Referring now to FIG. 9 of the drawings, in a preferred embodiment of the invention the quiver support 1 can be mounted on the bow grip 37 (illustrated in phantom) of a bow 35 under circumstances where the clip 20 illustrated in FIGS. 1 and 2 is removed from the clip base 16 and the clip base 16 then attached to the bow grip 37 by means of bolts or in any other convenient fashion. Accordingly, mounting of the clip base 16 tightly against the bow grip 37 maintains the coil spring 14 inside the spring seat 12, such that the coil spring 14 is operable to facilitate rotation of the quiver 27 and the attached quiver mount bracket 2 and spacer 10 into any desired configuration with respect to the bow 35 and bow grip 37 by application and release of compressive force, as described above.

Figure 10:
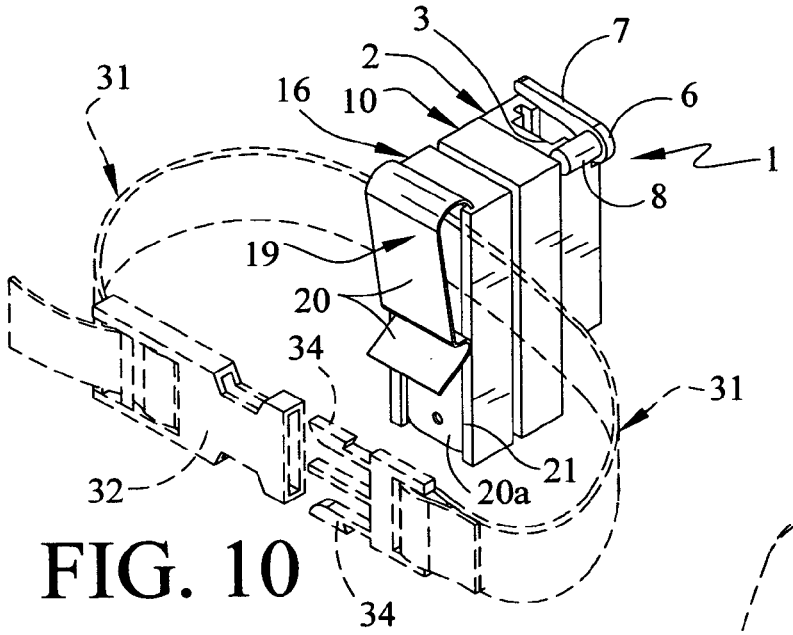
FIG. 10 is a perspective view of the rotatably adjustable quiver support illustrated in FIGS. 6-8, attached to a belt or the backpack strap of a backpack.
Figure 11:
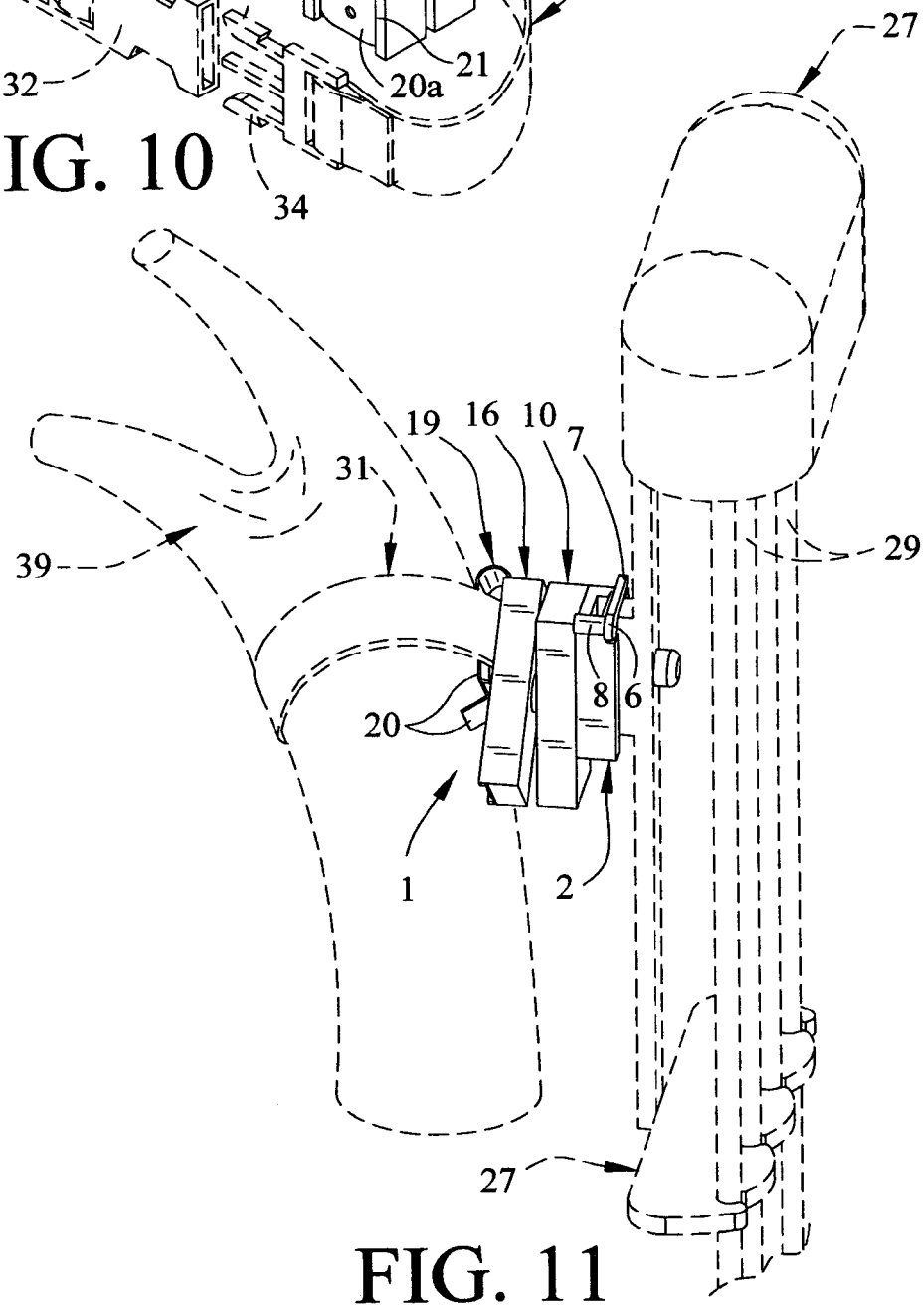
FIG. 11 is a perspective view of the rotatably adjustable quiver support illustrated in FIG. 10, with the backpack strap or belt clipped to the limb of a tree and the quiver, quiver mount bracket and spacer rotated with respect to the clip base.
Figure 12:
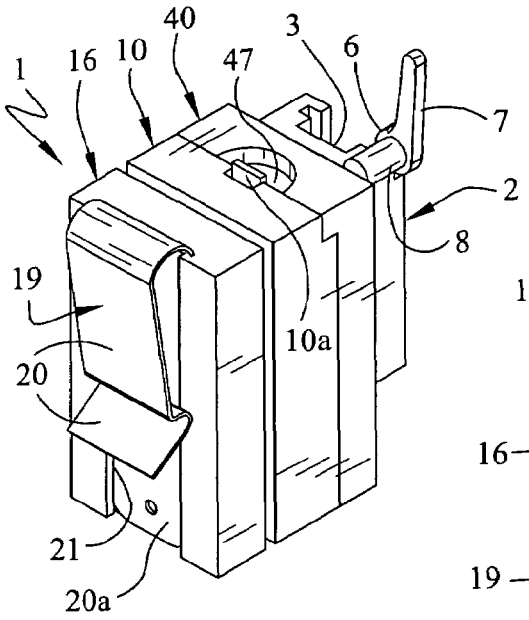
FIG. 12 is a perspective view of another preferred embodiment of the rotatable adjustable quiver support of this invention with a spike mount interposed between the quiver mount bracket and the spacer elements thereof.

Referring to FIGS. 10 and 11 of the drawings, the quiver support 1 can also be clipped to or otherwise mounted on a belt or strap 31, typically having a buckle 32 with engaging members 34 provided on the opposite end of the belt or strap 31 for engaging the buckle 32 and securing the belt or strap 31 around the waist of a user. Alternatively, as illustrated in FIG. 11, the belt or strap 31 can be wrapped and secured around the tree limb 39 of a tree 38 (illustrated in phantom). As in the case of the embodiments of the quiver support 1 described above and illustrated in FIGS. 1-9, the quiver 27, along with the quiver mount bracket 2 and spacer 10, can then be quickly and easily rotatably adjusted with respect to the fixed clip base 16 which is typically clipped to the belt or strap 31 by means of the clip 19.

Figure 13:
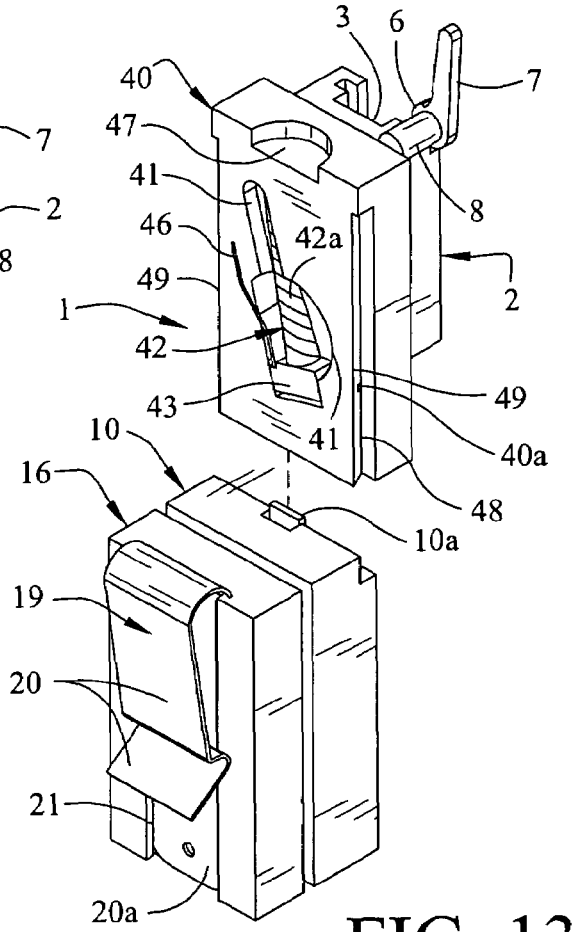
FIG. 13 is a perspective view of the rotatable adjustable quiver support illustrated in FIG. 12 with the spike mount detached, along with the quiver mount bracket, from the spacer element and a folding or hinged spike recessed in the spike mount.
Figure 14:
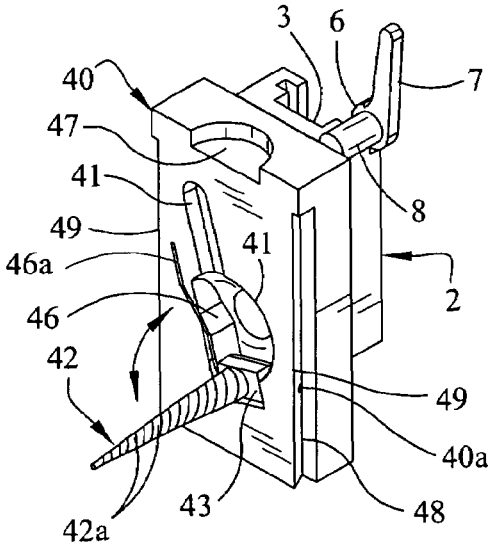
FIG. 14 is a perspective view of the spike mount illustrated in FIGS. 12 and 13 with the spike hingedly extended from a spike recess into functional configuration for threading into a tree or tree limb (not illustrated)
Figure 15:
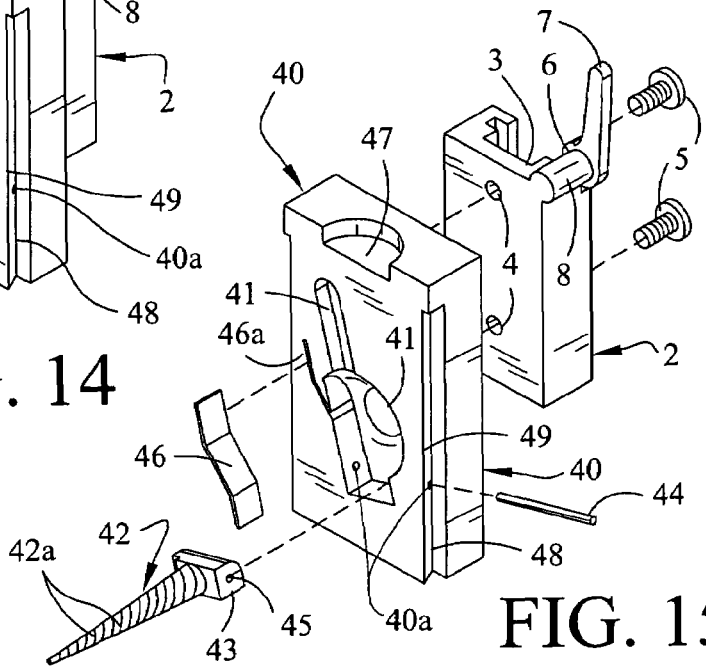
FIG. 15 is an exploded view of the spike mount illustrated in FIG. 14 with the quiver mount bracket detached therefrom.
Figure 17:
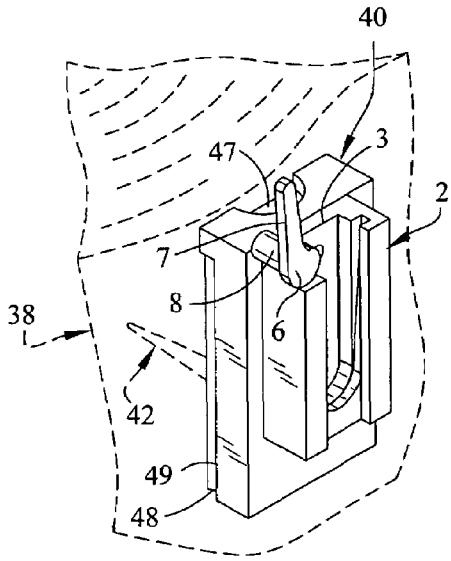
FIG. 17 is a perspective view of the spike mount illustrated in FIG. 14, with the spike element threaded into a tree (illustrated in phantom) to support the quiver and arrows in a selected orientation with respect to the tree.

Referring now to FIGS. 12-17 of the drawings in another preferred embodiment of the invention a spike mount 40 is interposed between the quiver mount bracket 2 and the clip base 16 of the rotatably adjustable quiver support 1. The spike mount 40 is typically characterized by a shaped spike recess 41 that pivotally or hingedly receives a tapered spike 42, fitted with spike threads 42*a* and having a spike base 43 provided with a base pin opening 45 (FIG. 15) for hingedly attaching the spike base 43 and the spike 42 to the spike mount 40. As further illustrated in FIG. 15, a base pin 44 extends through aligned spike mount openings 40*a* provided in the spike mount 40 and the base pin opening 45 provided in the spike base 43 of the spike 42, to facilitate selectively folding or rotating the spike 42 and the spike base 43 into and from a shaped spike recess 41, as illustrated in FIG. 13. This design facilitates hingedly extending the spike 42 from the spike recess 41 into a substantially perpendicular relationship with respect to the face of the spike mount 40, as illustrated in FIGS. 14, 15 and 17 of the drawings. The spike 42 and spike base 43 are maintained in closed configuration in the spike recess 41 by means of a leaf spring 46, fitted in a shaped leaf spring slot 46*a* provided in the spike mount 40 adjacent to the spike recess 41, as illustrated in FIGS. 13-17. Furthermore, the quiver mount bracket 2 is typically removably secured to the spike mount 40 by a pair of mount bolts 5 as illustrated in FIG. 15 and as described above with respect to the other embodiments of the invention.

Referring again to FIGS. 12-15 and 17 of the drawings, a finger slot 47 is typically provided on the top of the spike mount 40 for inserting a finger and manipulating a retainer tab 10*a* on the spacer 10 to release the spike mount 40 from attachment to the spacer 10 at a spike mount dove tail slot 48. The spike mount dovetail slot 48 has corresponding spike mount dove tail edges 49 that engage a like-shaped dove tail configuration (not illustrated) provided in the adjacent spacer 10. Accordingly, under circumstances where it is desired to attach the quiver 27 and the attached quiver mount bracket 2, as well as the spike mount 40, to a tree 38 (illustrated in phantom) as shown in FIG. 17, the spike mount 40 is first released from the spacer 10 by manipulation of the retainer tab 10*a* as illustrated in FIG. 13. The recessed spike 42 is then extended in hinged fashion outwardly of the spike mount 40 by finger action against the tension in the leaf spring 46, to the configuration illustrated in FIG. 14. The spike mount 40 is then inserted in the tree 38 with a clockwise twisting or rotation such that the typically tapered spike threads 42*a* engage the tree 38 and securely, yet removably, position the spike mount 40 on the tree 38 as illustrated in phantom in FIG. 17. The quiver 27 is then re-inserted in the quiver mount bracket 2 by rotating the cam lever 7 to the upward open position as illustrated in FIG. 15, to facilitate insertion of the quiver mount plate 28 in the quiver mount bracket slot 3, as illustrated in FIG. 2 of the drawings and the quiver 27 is thusly mounted to the tree 38. Rotational adjustment of the quiver 27 and the arrows 29 (FIGS. 1 and 2) with respect to the tree 38 is effected by rotating the spike mount 40 in the clockwise or counterclockwise direction to position the arrows 29 and the quiver 27 in a desirable position with respect to the hunter.

Figure 18:
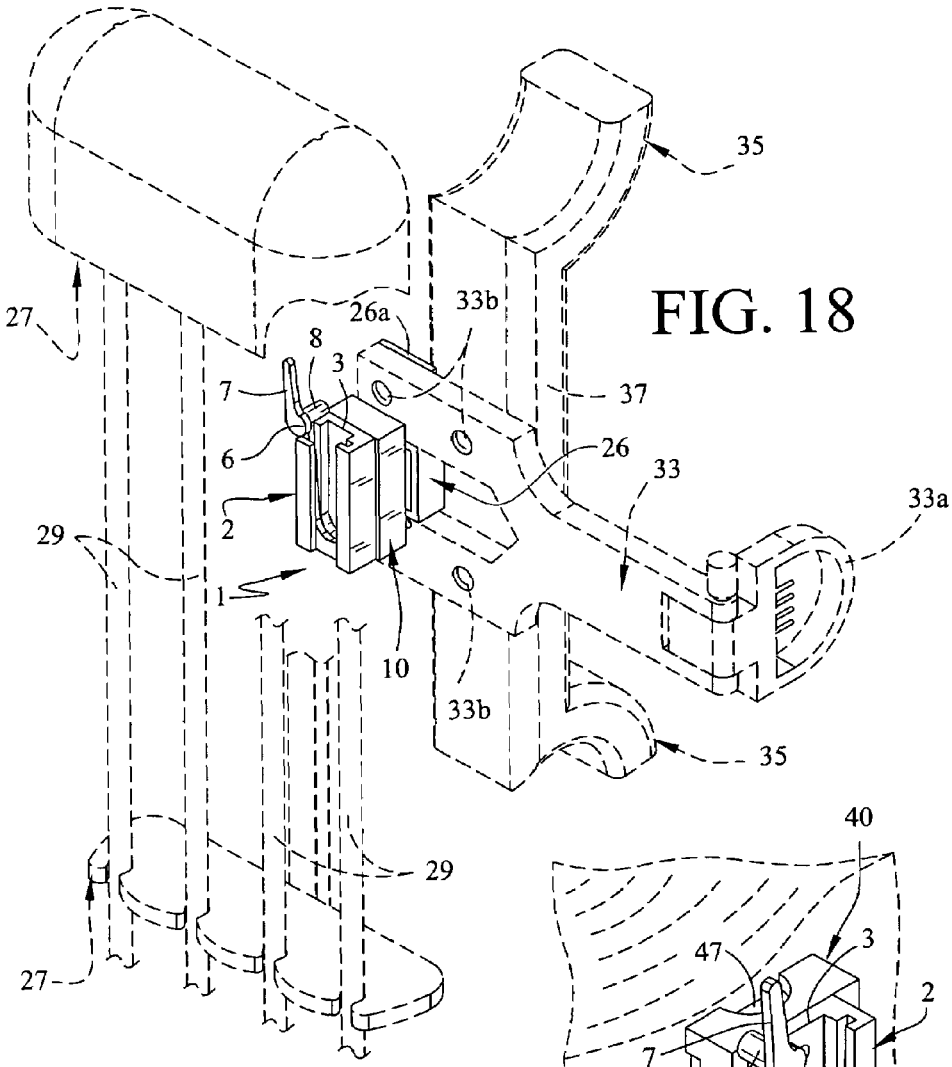
FIG. 18 is a perspective view of a quiver, quiver mount bracket and the spacer element attached to a bow sight mount using a modified clip base in the form of a spacer mount bracket and connected to the handle or grip of a bow (illustrated in phantom)
Figure 16:
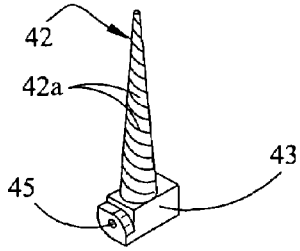
FIG. 16 is a perspective view of the spike and connected hinged spike base element of the spike mount illustrated in FIGS. 13-15.
Figure 19:
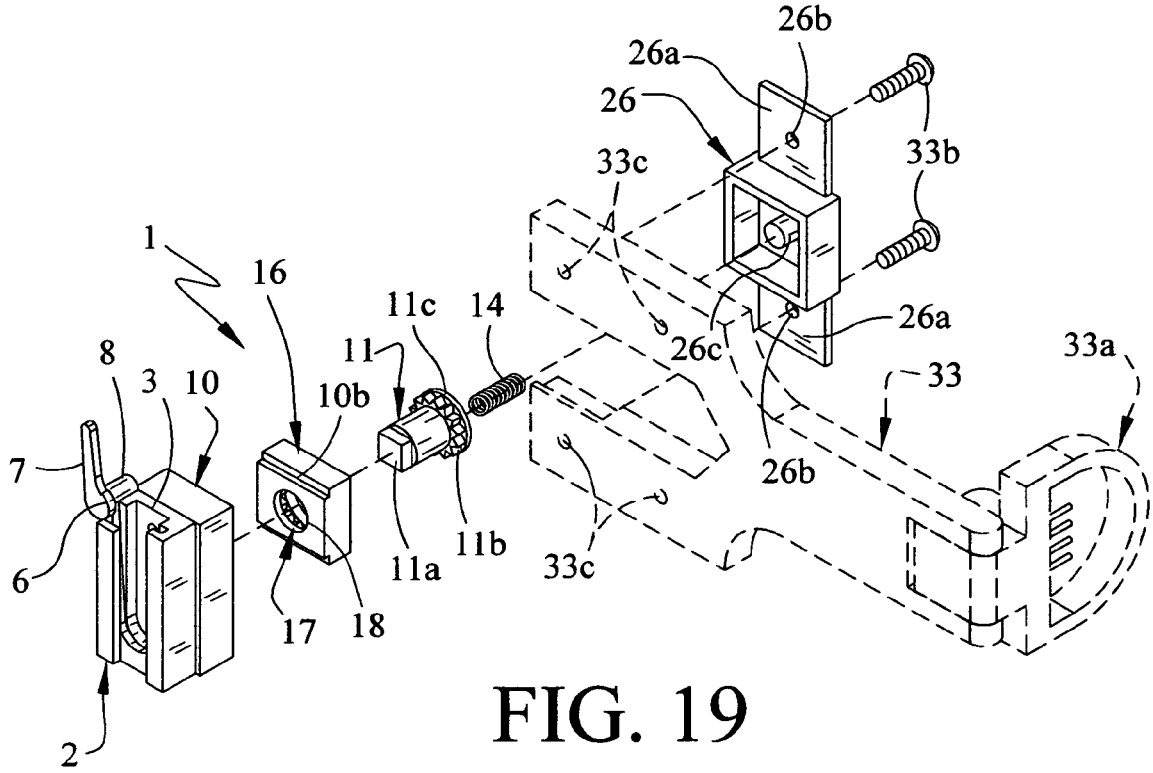
FIG. 19 is an exploded view of the bow sight mount, quiver mount bracket, spacer and the spacer mount bracket illustrated in FIG. 18, more particularly illustrating the spacer pivot and spring elements in relationship to the bow sight mount and bracket components thereof.

Referring now to FIGS. 18 and 19 of the drawings in another preferred embodiment of the invention the quiver support 1 can be secured to a bow sight mount 33 carrying a bow sight 33*a* (in phantom) as illustrated. The spacer 10 is fitted against one face of the bow sight mount 33 while the tabs 26*a* of a spacer mount bracket 26 are fitted against the opposite face of the bow sight 33. Bow sight mount bolts 33*b* (FIG. 19) are extended through aligned tab openings 26*b* in the spacer mount bracket tab 26*a* and through corresponding bolt openings 33*c* located in the spaced-apart legs of the bow sight mount 33 and then into tapped receptacles (not illustrated) provided in the spacer 10, to secure the spacer 10 and the quiver mount bracket 2, as well as a quiver 27 (FIGS. 1 and 2) to the bow sight mount 33. In a preferred embodiment of the invention a spacer pivot seat 26*c* is provided in an opening located in the center portion of the spacer mount bracket 26 for engaging the coil spring 14 at a corresponding opening (not illustrated) provided in the spacer pivot 11, to maintain the keeper teeth 11*b* and the spacer pivot cap 11*c* inside the pivot receptacle 17 located in the clip base 16 and facilitate assembly of the quiver support 1 on the bow sight mount 33 as illustrated in FIG. 18. The clip base 16 is typically provided with a lip 10*b* for engaging a corresponding projection (not illustrated) on the spacer 10 to facilitate rotation of the clip base 16 with the spacer 10 (FIG. 19). Accordingly, as further illustrated in FIG. 18, the quiver 27 can be rotatably adjusted along with the quiver mount bracket 2, the spacer 10 and the clip base 16 with respect to the spacer mount bracket 26 and the bow sight mount 33 in the manner above described with respect to the earlier described embodiments of the invention.

Figure 20:
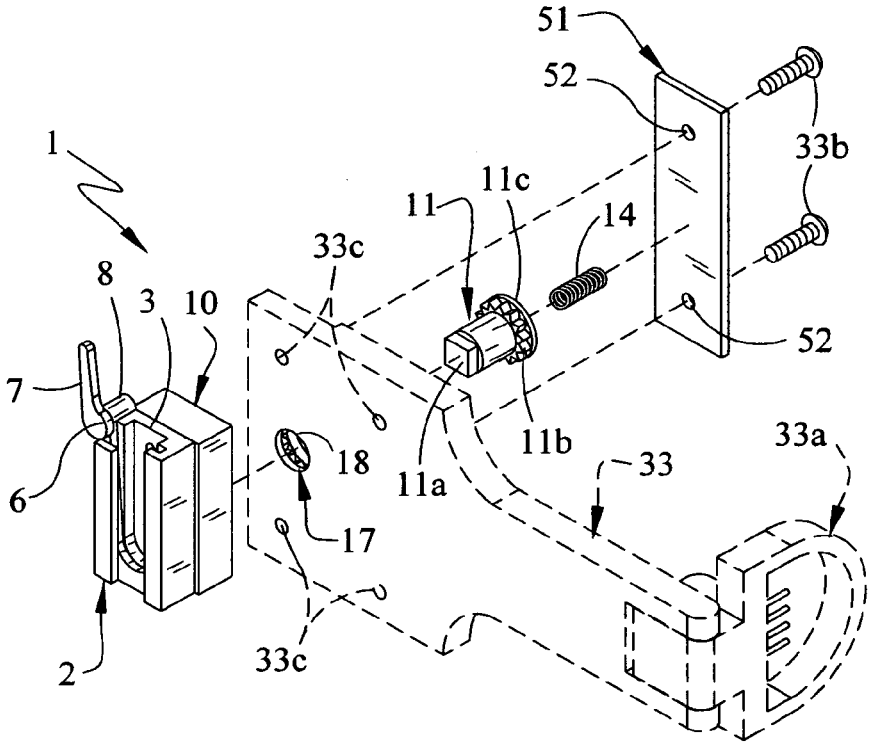
FIG. 20 is an exploded view of the quiver mount bracket, spacer and a mount plate in a typical mounting configuration of the rotatably adjustable quiver support on a bow sight mount of alternative design.

Referring to FIG. 20 of the drawings in another embodiment of the invention the bow sight mount 33 is solid and is fitted with a pivot receptacle 17, having receptacle grooves 18 therein in the same manner as the clip base 16 illustrated in FIG. 5 of the drawings. Accordingly, the quiver support 1 is assembled on the bow sight mount 33 using a spacer mount plate 51, provided with plate openings 52 for accommodating the two bow sight mount bolts 33*b* to rotatably mount the quiver 27 (FIG. 18) on the bow sight mount 33. Adjustment of the quiver 27, the quiver mount bracket 2 and the spacer 10 and clip base 16 with respect to the bow sight mount 33 is effected by compressive manipulation of the former with respect to the latter, as described above.

It will be appreciated by those skilled in the art that various techniques can be utilized for securing the cylindrically-shaped spacer pivot 11 in a corresponding pivot receptacle 17 of the clip base 16, in addition to the use of the clip 19, according to the knowledge of those skilled in the art. Furthermore, the clip 19 in each of the embodiments illustrated in the drawings can be attached to various structural elements, both located on the hunter and on a deer stand or blind or at any other desired location or position while hunting, further according to the knowledge of those skilled in the art. It will be further appreciated that other equipment, such as camera equipment, flashlights, bullet and other containers and the like, can be attached to the clip base 16 in place of the quiver 27 for selective rotational positioning according to the disclosure herein. Moreover, while the keeper teeth 11*b* are illustrated on the spacer pivot 11 and the receptacle grooves 18.are provided in the pivot receptacle 17, it will be appreciated that these engaging elements can be reversed, with the keeper teeth 11*b* provided in the pivot receptacle 17 and the receptacle grooves located on the spacer pivot 11, as desired.

It will also be appreciated by those skilled in the art that the coil spring 14 element of the quiver support 1 can be eliminated under circumstances where the keeper teeth 11*b* fit in the receptacle grooves 18 in a close tolerance, such that these elements remain removably engaged by friction. Moreover, other bias elements such as a rubber plug can be inserted in the spring seat 12 to provide a desired resilience in maintaining the keeper teeth 11*b* in the receptacle grooves 18.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A rotatably adjustable quiver support for mounting a quiver on a support, comprising a quiver mount bracket for engaging and supporting the quiver; a spacer carried by said quiver mount bracket; a spacer pivot projecting from said spacer in non-rotatable relationship, said spacer pivot defining a projecting end; a spacer pivot cap provided on said projecting end of said spacer pivot; a plurality of spacer pivot teeth provided on said spacer pivot cap facing said spacer; a coil spring provided in said spacer pivot; a clip base positioned opposite said spacer pivot; a clip provided on said clip base for engaging the support; a pivot receptacle provided in said clip base; and a plurality of receptacle grooves provided in said pivot receptacle, wherein said pivot receptacle rotatably receives said projecting end of said spacer pivot, said coil spring, said spacer pivot cap and said spacer pivot teeth, and said spacer pivot teeth selectively disengage said receptacle grooves responsive to depression of said coil spring and rotating the quiver, said quiver mount bracket and said spacer in concert with respect to said clip base and the support.

2. The rotatably adjustable quiver support of claim 1 comprising a spike mount removably interposed between said quiver mount bracket and said spacer and a spike hingedly carried by said spike mount for engaging a support and supporting said quiver mount bracket and the quiver when said spike mount is detached from said spacer and said spike is hingedly rotated against the support with said spike mount.

3. The rotatably adjustable quiver of claim 2 comprising a recess provided in said spike mount for receiving said spike in a first folded configuration; and a leaf spring extending into said spike mount and biased against said spike for biasing said spike in said first folded configuration in said recess.

4. A rotatably adjustable quiver support for mounting a quiver on a support, comprising a quiver mount bracket for supporting the quiver; a spacer carried by said quiver mount bracket; a cylindrical spacer pivot carried by said spacer in non-rotatable relationship, said spacer pivot defining a projecting end; a round spacer pivot can provided on said projecting end of said spacer pivot; a plurality of teeth carried by said spacer pivot cap and said projecting end of said spacer pivot; a mount base positioned opposite said spacer pivot for mounting on the support; a pivot receptacle provided in said mount base for rotatably receiving said projecting end of said spacer pivot, said spacer pivot cap and said teeth; a disengaging space provided in said pivot receptacle and receptacle grooves provided in said pivot receptacle adjacent to said disengaging space for selectively engaging said teeth; and a coil spring provided in said pivot receptacle and said spacer pivot for normally biasing said teeth in contact with said receptacle grooves, wherein said teeth are displaced from said receptacle grooves against the bias of said coil spring when said spacer cap moves into said disengaging space responsive to closing of said spacer against said mount base for selectively rotating the quiver, said quiver mount bracket and said spacer in concert with respect to said mount base and the support to a selected position of the quiver.

5. The rotatably adjustable quiver of claim 4 comprising a spike mount removably interposed between said quiver mount bracket and said spacer and a spike hingedly carried by said spike mount for engaging a support and supporting said quiver mount bracket and the quiver when said spike mount is detached from said spacer and said spike is hingedly rotated against the support with said spike mount.

6. The rotatably adjustable quiver support of claim 5 comprising a leaf spring and a recess provided in said spike base, said leaf spring extending into said recess for normally engaging said spike and removably retaining said spike in said recess.

7. The rotatably adjustable quiver support of claim 5 wherein said spike is tapered and comprising threads provided on said spike for threading said spike into said support.

* * * * *